United States Patent [19]

Keller et al.

[11] 4,144,026

[45] Mar. 13, 1979

[54] PROCESS FOR SIMULTANEOUSLY PROVIDING SYNTHETIC TEXTILE MATERIALS WITH AN ANTISTATIC AND DIRT-REPELLENT FINISH

[75] Inventors: Rudolf Keller, Riehen; Rosemarie Töpfl, Dornach, both of Switzerland

[73] Assignee: Ciba-Geigy Corporation, Ardsley, N.Y.

[21] Appl. No.: 809,590

[22] Filed: Jun. 24, 1977

[30] Foreign Application Priority Data

Jul. 6, 1976 [CH] Switzerland ..... 8627/76

[51] Int. Cl.[2] ..... D06M 13/00

[52] U.S. Cl. ..... 8/115.6; 260/23 AR

[58] Field of Search ..... 260/23 AR; 8/115.6

[56] References Cited

U.S. PATENT DOCUMENTS

| | | | |
|---|---|---|---|
| 3,013,997 | 12/1961 | Coler et al. | 260/23 AR |
| 3,521,993 | 7/1970 | Swidler et al. | 260/23 AR X |
| 3,598,514 | 8/1971 | Sello et al. | 8/115.6 |

*Primary Examiner*—Lewis T. Jacobs

*Attorney, Agent, or Firm*—Edward McC. Roberts

[57] ABSTRACT

A process for simultaneously providing synthetic textile materials with an antistatic and dirt-repellent finish, which process comprises treating said textile materials with an aqueous preparation which contains (a) a copolymer of an $\alpha,\beta$-unsaturated dicarboxylic acid or the anhydride thereof and at least one other ethylenically unsaturated compound, and (b) a fatty acid/alkanolamine reaction product or an alkylene oxide adduct of this reaction product, and subsequently drying them.

24 Claims, No Drawings

PROCESS FOR SIMULTANEOUSLY PROVIDING SYNTHETIC TEXTILE MATERIALS WITH AN ANTISTATIC AND DIRT-REPELLENT FINISH

It is known to treat textile materials, including also synthetic fibrous materials, with agents which impart to said materials an antistatic and/or dirt-repellent finish.

Although the finished textile materials exhibit acceptable antistatic effects, the dirt repellency remains unsatisfactory. In some cases even a deterioration of the anti-soiling effect must be accepted, which means in effect that the advantages of the antistatic finish are virtually cancelled out by these disadvantages (soiling). It is therefore the task of the present invention to provide a novel process for providing synthetic textile materials with an antistatic finish and simultaneously for improving the dirt-repellent properties of these materials.

Accordingly, the invention relates to a process for simultaneously providing synthetic textile materials with an antistatic and dirt-repellent finish, which process comprises treating said textile materials with an aqueous preparation which contains (a) a copolymer of an $\alpha,\beta$-unsaturated dicarboxylic acid or the anhydride thereof and at least one other ethylenically unsaturated compound, and (b) a fatty acid-alkanolamine reaction product or an alkylene oxide adduct of this reaction product, and subsequently drying them.

The copolymers (a) can be in the form of free acids or salts, for example alkali metal salts or alkaline earth metal salts or salts of a volatile base, or also in the form of an ester.

The invention also encompasses the aqueous preparations for carrying out the process as well as the textile materials which are provided with the antistatic and dirt-repellent finish. In this connection, the term "dirt-repellent finish" is to be understood as meaning the capacity to keep to a minimum or to prevent the soiling of textile materials by aqueous or oily dirt as well as the dry soiling thereof.

Suitable $\alpha,\beta$-unsaturated dicarboxylic acids for obtaining the copolymers (a) are normally those having 4 or 5 carbon atoms, preferably the anhydrides thereof, such as in particular anhydrides of itaconic acid and especially of maleic acid. The ethylenically unsaturated comonomers can be ethylene, vinyl alcohol, vinylalkyl ethers, vinyl esters or in particular styrene.

The vinylalkyl ethers advantageously contain 1 to 4, preferably 1 or 2, carbon atoms in the alkyl moiety. As examples there may be mentioned: methyl vinyl ether, isopropyl vinyl ether, isobutyl vinyl ether, vinyl-2-methoxyethyl ether, n-propyl-vinyl ether and n-butylvinyl ether. A suitable vinyl ester is in particular vinyl acetate.

The copolymers are prepared by known methods and then hydrolysed, provided an anhydride of an $\alpha,\beta$-unsaturated dicarboxylic acid, in particular maleic anhydride, is used. The carboxyl groups in the copolymers are advantageously in salt form, that is to say for example in the form of alkali metal, alkaline earth metal, ammonium or amine salts. The corresponding alkali metal salts, especially sodium or potassium salts, or ammonium salts, are preferred.

Optionally, the carboxyl groups can also be partially or completely esterified, in which case monoalcohols containing 1 to 4 carbon atoms or mono- or polyethylene glycol monoalkyl ethers of the formula $$RO(CH_2CH_2O)_m H \quad (1)$$

wherein R represents methyl or ethyl and m is an integer from 1 to 10, preferably 1 to 5, can be used as alcohol component. Mixtures of these alcohol components can also be used.

In the partially esterified copolymers, the ratio of carboxyl groups to ester groups can be 5:1 to 1:5, preferably 2:1 to 1:2.

Preferred components (a) are copolymers, in the form of alkali metal salts, of maleic acid and ethylene, vinylalkyl ether, vinyl ester or, in particular, styrene.

The copolymers usually contain on average 3 to 900, in particular 4 to 600 and preferably 20 to 500, units, which are derived from the $\alpha,\beta$-unsaturated dicarboxylic acid or acids (or the anhydride or anhydrides thereof) and the other ethylenically unsaturated compounds. The ratio of the units to one another is normally 1:1.

The copolymers can have average molecular weights of 800 to 180,000 and preferably of 4000 to 100,000. The intrinsic viscosity $\eta$ [dl/g] is between 0.1 and 1.2 of a 1% by weight solution.

The preferred copolymers can be illustrated for example by the recurring unit of the formula

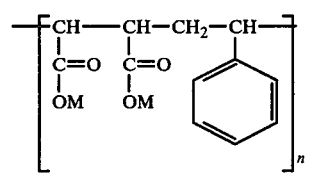

(2)

wherein M represents an alkali metal, ammonium or amine cation, whilst both symbols M together represent an alkaline earth metal cation and n is an integer from 3 to 900, in particular 4 to 600 and preferably 20 to 500.

M denotes in particular alkali metal or ammonium ($NH_4$).

The recurring units of the copolymers in which the comonomers are ethylene or vinylalkyl ether, are described for example in the formulae

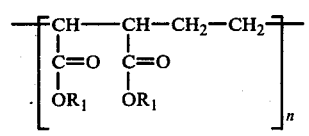

(3)

and

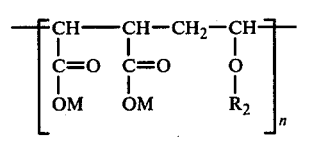

(4)

wherein $R_1$ represents hydrogen or M and $R_2$ represents alkyl of 1 to 4, preferably 1 or 2, carbon atoms, and M and n have the given meanings.

The fatty acid/alkanolamine reaction products suitable as component (b) can be derived from fatty acids containing 12 to 22 carbon atoms and from alkanolamines containing 2 or 3 carbon atoms in each alkanol moiety.

Preferred reaction products are those of fatty acids containing 14 to 20, in particular 16 to 18, carbon atoms. As alkanolamine it is possible to use for example ethanolamine, diethanolamine, propanolamine, isopropanolamine or diisopropanolamine. Dialkanolamines, in particular diethanolamine, are preferred. The molar ratio between fatty acid and dialkanolamine can be 1:1 to 1:2. As examples of fatty acids there may be mentioned: lauric, myristic, palmitic, stearic, arachidic or behenic acid. The mixtures of these acids which are used in the cleavage of natural oils or fats can also be used. Palmitic/stearic acid mixtures are particularly preferred.

The mixture ratios can be 40:60 to 60:40 (in parts by weight).

The reaction products of the component (b) and the process for their manufacture are known for example from U.S. Pat. No. 2,089,212.

Suitable for use as component (b) are also alkylene oxide adducts, in particular ethylene oxide adducts, of the fatty acid/alkanolamine reactions products mentioned above, whilst individual ethylene oxide units can be replaced by substituted epoxides, such as propylene oxide or styrene oxide.

The number of alkylene oxide groups in these glycol ethers can be 1 to 8 and preferably 1 to 4. Adducts of 2 to 4 moles of ethylene oxide with 1 mole of the reaction product of 1 mole of stearic acid and/or palmitic acid with 2 moles of diethanolamine are preferred.

Suitable synthetic textile materials which can be treated by the process of the present invention are for example those made from polyamide, polyester, polyacylonitrile or polyolefins, and blends thereof. Polyamide textile materials are preferred. The textile materials made from the above types of fabric can be undyed or preferably dyed and are advantageously in the form of flocks, tops, wovens, knits, non-wovens, yarn or piece goods. Examples of piece goods are in particular floor coverings, for example tufted carpets, or other domestic textiles, such as upholstery fabrics, curtains or wall coverings. The finishing of carpet materials, in particular those made from synthetic polyamide, is preferred.

The finishing of the textile materials is advantageously carried out by spraying, impregnating, slop-padding or by the exhaustion process, if appropriate also by brushing. This treatment is preferably carried out at room temperature or slightly elevated temperature (in the range from approx. 15° to 40° C.). For this treatment it is possible to use aqueous preparations which contain the components (a) and (b) and are particularly in the form of aqueous solutions, emulsions or dispersions. These preparations advantageously have a solids content of approx. 0.4 to 2.5 percent by weight. The pH of the preparations can be in the range from 2.5 to 10, but is advantageously between 3 and 8 and preferably between 5 and 8.

The content of component (a) in the aqueous preparations can be about 0.3 to 1.5, preferably 0.6 to 0.8, percent by weight, whilst the content of component (b) can be from 0.1 to 1, preferably 0.1 to 0.5, percent by weight.

The aqueous preparations can contain as further additives for example acids, in particular low molecular organic acids, such as formic or acetic acids, for adjusting the pH, thickeners, solvents or antifoams. Optionally, further finishing or improving agents, for example antimicrobial agents, can also be applied simultaneously with the antistatic and dirt-repellent finish.

The treated textile materials can be dried at a temperature of 20° to 180° C. Preferably they are dried at 80° to 100° C., after which they can optionally be after-treated at a temperature of over 100° C., preferably between 100° and 130° C.

According to the present invention, the component mixture is advantageously sprayed uniformly in the form of an aqueous emulsion (spray liquor) onto the wet or dry material to be treated by means of spray equipment in such an amount (for example 20 to 120 percent by weight, referred to the material) that, after drying the material at approx. 80° to 100° C. and optionally after a curing at a temperature above 100° C., for example between 100 and 180° C., preferably 100° and 130° C., sufficient component mixture remains on the surface of the material so as to obtain the desired antistatic and dirt-repellent effects.

The treated textile materials, in particular carpets, exhibit good antistatic effects, i.e. no troublesome discharges arise on coming into contact with or treading on them and the antisoiling tendency is markedly diminished. Furthermore, the handle and fastness to rubbing and, in the case of dyed materials, also the lightfastness, are not adversely affected by the finish. The finishes on carpets are fast to shampooing and are also not adversely affected by brushing and vacuum cleaning.

The following Examples illustrate the invention and show that textile fibrous materials with antistatic and simultaneously improved dirt-repellent properties are obtained by treating them by the process according to the invention. The electrostatic charge (as gauge of the antistatic effect) is measured in volts and the soiling according to the AATCC grey scale (rating from 1 to 5, with 5 being the highest rating). The susceptibility limit for humans is 3000 volts (Modern Textiles Magazine, January 1972, J. A. Gusack, Williamsburg, VA., U.S.A.).

In the Examples, parts and percentages are by weight unless otherwise stated. The following copolymers and reaction products and adducts are examples of components (a) and (b) of the method examples. The copolymers are used in hydrolysed form. The intrinsic viscosity values $\eta$ [dl/g] (1%) however refer to non-hydrolysed copolymers.

Component (a)

| | |
|---|---|
| $A_1$ | sodium salt of the copolymer of maleic anhydride/styrene, $\eta$ (1%) = 0.25 |
| $A_2$ | ammonium salt of the copolymer of maleic anhydride/ethylene, $\eta$ (1%) = 0.44 |
| $A_3$ | sodium salt of the copolymer of maleic anhydride/methyl vinyl ether, $\eta$ (1%) = 0.48 |
| $A_4$ | sodium salt of the copolymer of maleic anhydride/vinyl acetate, $\eta$ (1%) = 0.27 |
| $A_5$ | sodium salt of the copolymer of maleic anhydride/vinyl acetate, $\eta$ (1%) = 1.02 |
| $A_6$ | sodium salt of the copolymer of maleic anhydride/vinyl alcohol, $\eta$ (1%) = 0.27 |

Component (b)

| | |
|---|---|
| $B_1$ | reaction product of 1 mole of stearic acid with 2 moles of di-(2-hydroxyethyl)-amine |
| $B_2$ | reaction product of 1 mole of a palmitic/stearic acid mixture (e.g. 40:60 parts by weight) with 2 moles of di-(2-hydroxyethyl)-amine |
| $B_3$ | adduct of 2 moles of ethylene oxide with 1 mole of reaction product $B_2$ |
| $B_4$ | adduct of 4 moles of ethylene oxide with 1 mole of reaction product $B_2$ |
| $B_5$ | adduct of 2 moles of ethylene oxide with 1 mole of reaction product $B_1$ |

-continued

| | |
|---|---|
| $B_6$ | adduct of 4 moles of ethylene oxide with 1 mole of reaction product $B_1$. |

EXAMPLE 1

A polyamide carpet (500 g/m$^2$ of polyamide, total weight 650 g/m$^2$) is sprayed wet in wet at room temperature by the spray method to a liquor pick-up of 50% with a spray liquor which contains 12 g/l of the sodium salt of the copolymer of maleic anhydride/styrene $A_1$ 3 g/l of the reaction product $B_2$, and 2 ml of 80% acetic acid.

The carpet is then dried at 100° C. until it is completely dry. The charge and the soiling tendency are reported in Table 1.

Table 1

| | Charge (volts) | Soiling (AATCC grey scale) |
|---|---|---|
| treated | 500 - 1500 | 3 |
| untreated | 8000 - 12000 | 2 |

The difference in the soiling is plain. The carpet is provided with a dirt-repellent as well as an antielectrostatic finish and retains these properties even after continuous treading, brushing down and vacuum cleaning.

EXAMPLE 2

A needlepunched fabric with a total weight of approx. 1000 g and a polyamide walking layer of approx. 350 g is impregnated with a conventional binder dispersion which contains, per kg of aqueous liquor, additionally 10 g of the sodium salt of the copolymer of maleic anhydride/styrene $A_1$ 3 g of the reaction product $B_2$ and 5 g of sodium acetate.

The liquor pick-up is approx. 100%. The needlepunched fabric is dried at 100° C. and then subjected to a further treatment at 130° C. The bonded and finished textile floor covering exhibits good antielectrostatic properties as well as a reduced soiling tendency when being continuously trodden.

The finish is fast to cleaning in comparison with a non-finished floor covering.

Table 2

| | Charge (volts) | Soiling (AATCC grey scale) |
|---|---|---|
| treated | 800 - 1500 | 3 |
| untreated | 4000 - 7000 | 2 |

Similar results are obtained by using 15 g of the copolymer $A_1$, 5 g of the reaction product $B_2$ and 15 g of sodium acetate.

EXAMPLES 3 to 13

A prewashed white polyamide carpet (weight 800 g/m$^2$) is impregnated in each of these Examples with an aqueous liquor which contains as antistatic agent and anti-soiling component the combination products (a) and (b) listed in the second and third columns respectively of Table 3. The liquor pick-up is 100%. The carpet material is then dried for 1 hour at 80° C. and subjected to a further treatment for 3 minutes at 130° C. The charge in volts and the soiling tendency are indicated in the fourth and fifth columns respectively. The soiling is rated according to the AATCC grey scale.

Table 3

| Example | Component (a) in g/l | Component (b) in g/l | Charge (volts | Soiling |
|---|---|---|---|---|
| 3 | 7.8 $A_2$ | 3.2 $B_2$ | 1700–2500 | 3 |
| 4 | 7.8 $A_3$ | 3.2 $B_2$ | 400–1100 | 3 |
| 5 | 7.8 $A_4$ | 3.2 $B_2$ | 400–850 | 2–3 |
| 6 | 7.8 $A_5$ | 3.2 $B_2$ | 300–800 | 2–3 |
| 7 | 7.8 $A_6$ | 3.2 $B_2$ | 250–650 | 2–3 |
| 8 | 8.05 $A_1$ | 2.95 $B_2$ | 200–550 | 3 |
| 9 | 8.05 $A_1$ | 2.95 $B_3$ | 500–1300 | 3 |
| 10 | 8.05 $A_1$ | 2.95 $B_4$ | 300–850 | 3 |
| 11 | 8.05 $A_1$ | 2.95 $B_1$ | 300–700 | 3 |
| 12 | 8.05 $A_1$ | 2.95 $B_5$ | 450–1200 | 3 |
| 13 | 8.05 $A_1$ | 2.95 $B_6$ | 600–1500 | 3 |

What we claim is:

1. A process for simultaneously providing a synthetic textile with an antistatic and dirt-repellent finish, comprising the steps of treating said textile with an aqueous preparation which consists essentially of (a) 0.3 to 1.5% by weight of a copolymer of an $\alpha,\beta$-unsaturated dicarboxylic acid or the anhydride thereof and at least one other ethylenically unsaturated compound, and (b) 0.1 to 1% by weight of a fatty acid/alkanolamine reaction product or an alkylene oxide adduct of this reaction product, and subsequently drying the textile.

2. A process according to claim 1 wherein the copolymer (a) is a free acid, a salt or it is partially or completely esterified.

3. A process according to claim 1 wherein the copolymer (a) is an alkali metal salt, alkaline earth metal salt or a salt of a volatile base.

4. A process according to claim 1 wherein the copolymer (a) is an alkali metal salt, alkaline earth metal salt, ammonium salt or amine salt.

5. A process according to claim 1 wherein component (a) is an alkali metal salt of a copolymer of maleic anhydride and a comonomer selected from ethylene, vinyl ester, vinylalkyl ether and styrene.

6. A process according to claim 1 wherein component (a) is an alkali metal salt of a copolymer of maleic anhydride and styrene.

7. A process according to claim 1 wherein component (a) is a copolymer with an average molecular weight of 800 to 100,000.

8. A process according to claim 1 wherein component (a) is a copolymer with an average molecular weight of 4000 to 100,000.

9. A process according to claim 1 wherein component (a) has an intrinsic viscosity $\eta$ of 0.1 to 1.2 dl/g.

10. A process according to claim 1 wherein component (b) is a fatty acid/alkanolamine reaction product.

11. A process according to claim 10 wherein component (b) is a fatty acid/alkanolamine reaction product of a fatty acid of 12 to 22 carbon atoms and a dialkanolamine having 2 or 3 carbon atoms in each alkanol moiety.

12. A process according to claim 11 wherein component (b) is a fatty acid/dialkanolamine reaction product of a fatty acid of 14 to 20 carbon atoms and diethanolamine.

13. A process according to claim 12 wherein component (b) is a fatty acid/dialkanolamine reaction product of a fatty acid of 16 to 18 carbon atoms and diethanolamine.

14. A process according to claim 13 wherein component (b) is a reaction product of 1 mole of a palmitic acid/stearic acid mixture and 2 moles of diethanolamine.

15. A process according to claim 1 wherein component (b) is an adduct of 2 to 4 moles of ethylene oxide with 1 mole of a reaction product of 1 mole of stearic acid or of a palmitic acid/stearic acid mixture with 2 moles of diethanolamine.

16. A process according to claim 1 wherein the textile is treated with the aqueous preparation at 15° to 40° C.

17. A process according to claim 1 wherein the treated textile is dried at a temperature of 20° to 180° C.

18. A process according to claim 1 wherein the treated textile is dried at a temperature of 80° to 100° C.

19. A process according to claim 18, comprising the further step of heating the treated and dried textile at a temperature in the range of 100°–130° C.

20. A process according to claim 1 wherein the textile is made from synthetic polyamide.

21. A process according to claim 20 wherein the textile is carpet made from synthetic polyamide.

22. An aqueous preparation for simultaneously providing a synthetic textile with an antistatic and dirt-repellent finish, which consists essentially of (a) 0.3 to 1.5% by weight of a copolymer of an $\alpha,\beta$-unsaturated dicarboxylic acid or the anhydride thereof and at least one other ethylenically unsaturated compound, and (b) 0.1 to 1% by weight of a fatty acid/alkanolamine reaction product or an alkylene oxide adduct of this reaction product.

23. An aqueous preparation according to claim 22 in the form of a solution, emulsion or dispersion.

24. A synthetic textile which is provided with an antistatic and dirt-repellent finish by a process which comprises treating the textile with an aqueous preparation which consists essentially of (a) 0.3 to 1.5% by weight of a copolymer of an $\alpha,\beta$-unsaturated dicarboxylic acid or the anhydride thereof and at least one other ethylenically unsaturated compound, and (b) 0.1 to 1% by weight of a fatty acid/alkanolamine reaction product or an alkylene oxide adduct of this reaction product, and subsequently drying the textile.

* * * * *